US005505522A

United States Patent [19]

Marshall et al.

[11] Patent Number: 5,505,522

[45] Date of Patent: Apr. 9, 1996

[54] DEFLECTABLE SEAT BACK

[75] Inventors: Richard E. Marshall, Monroe; Jonathan R. Saul, LaSalle; Larry P. LaPointe, Temperance, all of Mich.

[73] Assignee: La-Z-Boy Chair Company

[21] Appl. No.: 184,728

[22] Filed: Jan. 31, 1994

[51] Int. Cl.[6] ..... A47C 3/00

[52] U.S. Cl. ..... 297/301.4; 297/303.4; 297/374; 297/440.21

[58] Field of Search ..... 297/306, 291, 297/304, 440.21, 285, 374, 301.4, 301.5, 301.6, 285, 303.1, 303.4

[56] References Cited

U.S. PATENT DOCUMENTS

| | | | |
|---|---|---|---|
| 2,427,174 | 9/1947 | White | 297/285 X |
| 3,525,549 | 8/1970 | Knabusch et al. | 297/440.21 |
| 3,973,798 | 8/1978 | White . | |
| 4,477,118 | 10/1984 | Ruble . | |
| 4,693,514 | 9/1987 | Volkle | 297/374 |
| 4,852,943 | 8/1989 | Roper | 297/304 X |
| 5,184,871 | 2/1993 | LaPointe et al. . | |

FOREIGN PATENT DOCUMENTS

| | | | |
|---|---|---|---|
| 2120540 | 12/1983 | United Kingdom | 297/440.21 |

*Primary Examiner*—Laurie K. Cranmer
*Attorney, Agent, or Firm*—Harness, Dickey & Pierce

[57] ABSTRACT

A mechanism is provided for detachably interconnecting a seat base and a seat back of a chair such that the application of pressure to the seat back causes deflection therebetween and which returns to its normal orientation upon releasing the applied pressure. The mechanism includes a plate member secured to the chair frame adjacent the seat base. A upstanding link member is pivotably secured to the plate member and the two are interconnected with a spring member for providing resistance to the pivoting motion. The upstanding link member is further formed with a lost-motion slot through which extends a pin which is secured into the plate member for thereby limiting the amount of deflection. The upper portion of the upstanding link member is formed to receive a detachable seat back assembly. The detachable seat back mechanism of the present invention is also uniquely adapted to provide at least two means for adjusting the amount of pressure required on the seat back to cause deflection.

9 Claims, 4 Drawing Sheets

FIG 1
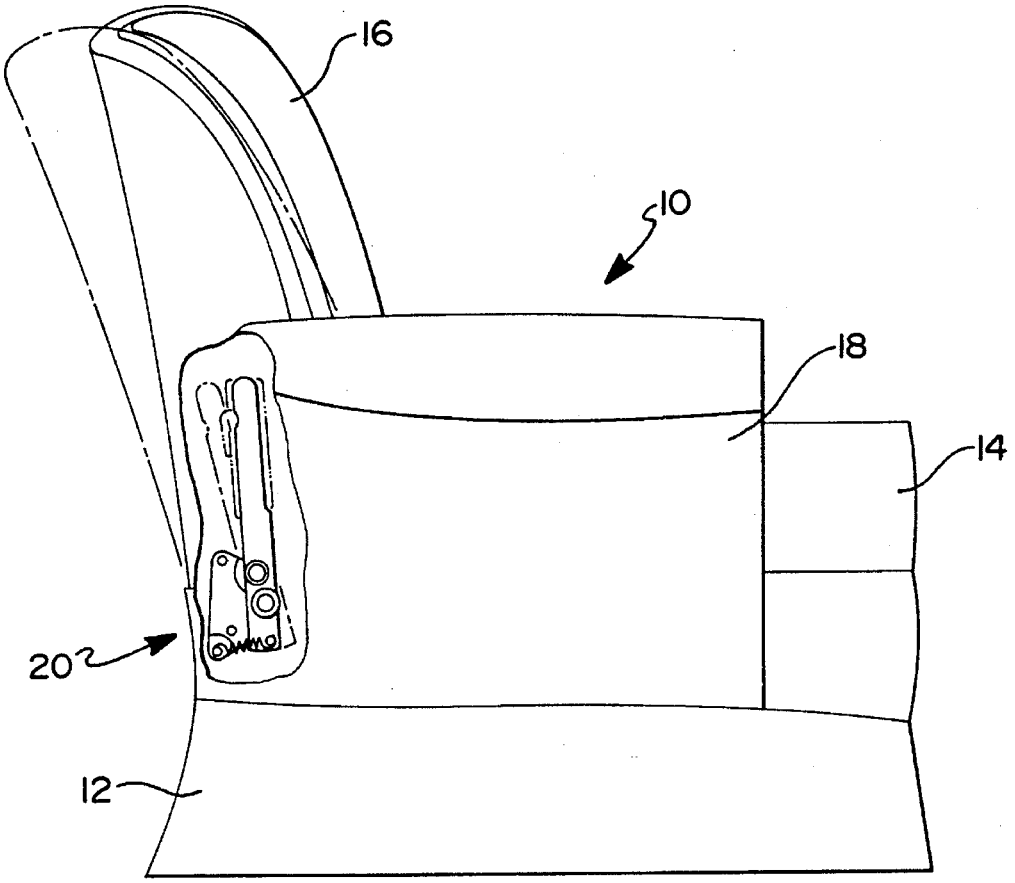
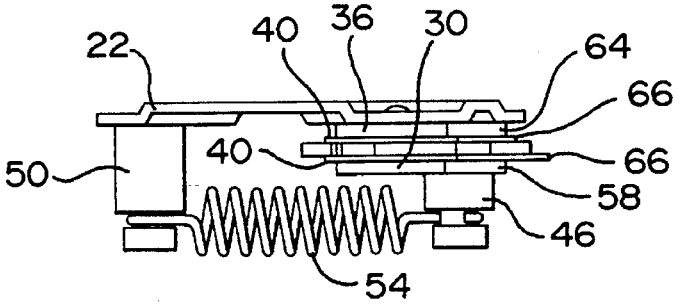
FIG 3

FIG 4
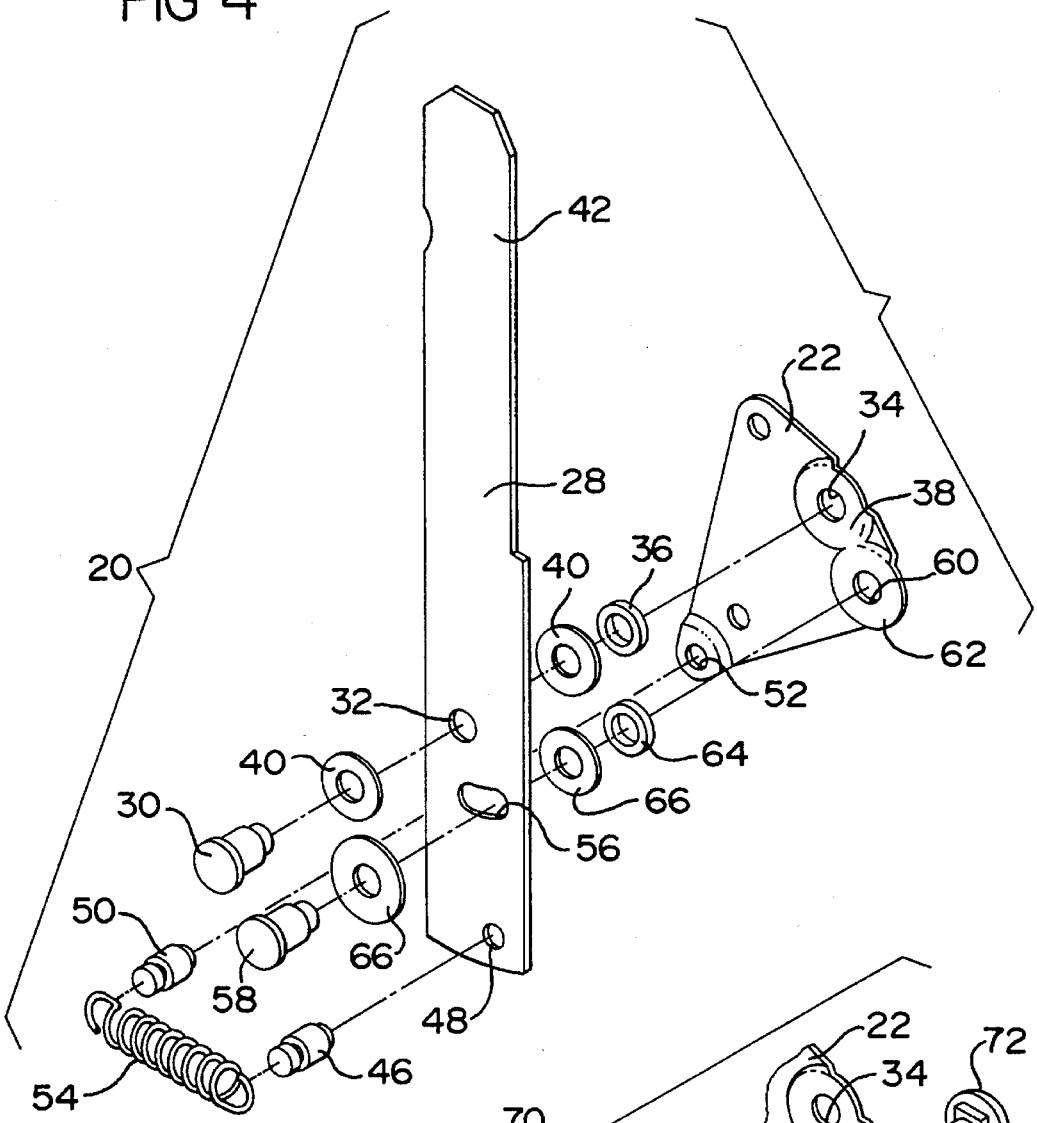
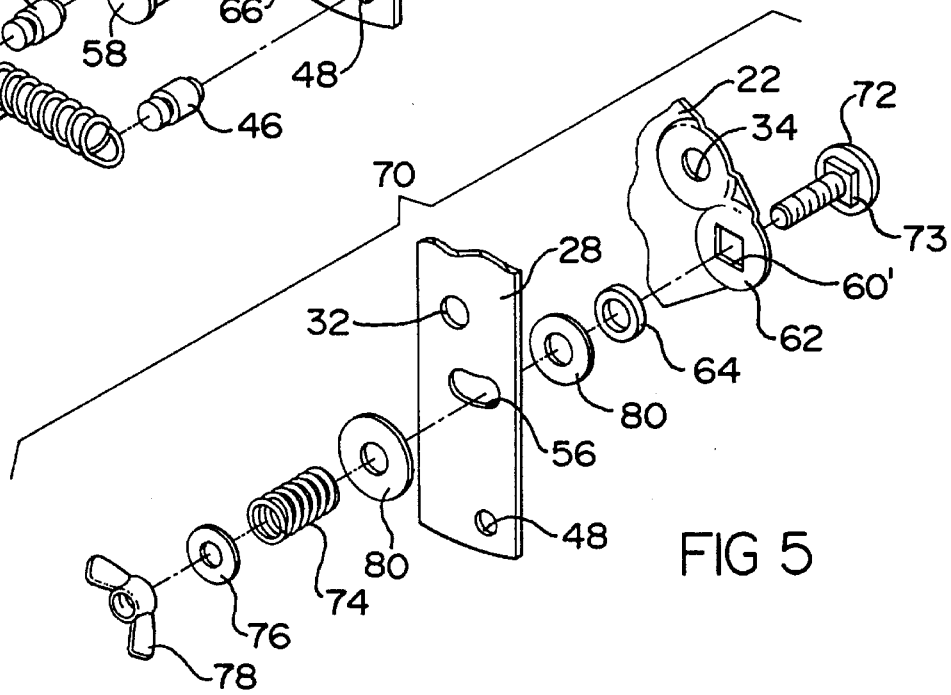
FIG 5

DEFLECTABLE SEAT BACK

BACKGROUND OF THE INVENTION

The present invention relates generally to articles of furniture and, more particularly, to a deflectable seat back mechanism for supporting a seat back relative to a seat member and for allowing a limited amount of deflection of the seat back relative to the seat.

It is known in the furniture industry to construct the interconnection of the seat base and seat back of a chair to allow a small amount of deflection of the seat back relative to the seat base, i.e., an increase in the included angle between the seat base and the seat back. For example, commonly assigned U.S. Pat. No. 3,973,798 discloses a pair of spaced, spring rods adapted to support the seat back relative to the seat base and to permit, upon application of pressure to the seat back, a relative amount of deflection therebetween. Other arrangements for deflectable chair backs include supporting the seat back from a single, centrally located flat spring member. This arrangement is common in office/secretarial chairs and the like. The flat spring member allows deflection of the seat back relative to the seat base upon the application of pressure to the seat back.

One disadvantage of the known arrangements for achieving a deflectable seat back is that they do not provided sufficient lateral and torsional support for the seat back. That is, if pressure is unequally applied to the seat back, the seat back is caused to twist as well as deflect or to deflect laterally relative to the seat base generally making the chair less comfortable. In addition, these known arrangements do not provide for allowing the user to adjust the amount of force required to cause deflection of the seat back. Moreover, these known deflectable seat back designs do not provide for detaching the chair back such that the chair can be made compact for shipping and storage.

SUMMARY OF THE INVENTION

Accordingly, it is a primary object of the present invention to provide a mechanism for interconnecting a seat back to a seat base such that application of pressure to the seat back causes a controlled deflection of the seat back relative to the seat base.

It is an additional object of the present invention to provide a deflectable seat back mechanism which permits the seat back to be detachably secured relative to the seat base.

Still another object of the present invention is to provide a detachable seat back mechanism which includes means for adjusting the amount of pressure required against the seat back to cause deflection.

It is yet another object of the present invention to provide a deflectable seat back mechanism which inhibits twisting and lateral deflection of the seat back relative to the seat base.

In accordance with the principles of the present invention, a mechanism is disclosed for detachably interconnecting a seat base and a seat back of a chair such that the application of pressure to the seat back causes deflection therebetween. The mechanism includes a plate member secured to the chair frame adjacent the seat base. A upstanding link member is pivotably secured to the plate member and the two are interconnected with a spring member for providing resistance to the pivoting motion. The upstanding link member is further formed with a lost-motion slot through which extends a pin member which is secured into an aperture formed in the plate member thereby limiting the amount of deflection. The upper portion of the upstanding link member is formed to receive a detachable seat back assembly. The detachable seat back mechanism of the present invention is also uniquely adapted to provide at least two means for adjusting the amount of pressure required on the seat back to cause deflection.

Additional objects, advantages, and features of the present invention will become apparent from the following description and appended claims, taken in conjunction with the accompanying drawings.

DESCRIPTION OF THE DRAWINGS

FIG. 1 is a side view of a typical chair partially broken away to illustrate the adaptation of the deflectable seat back mechanism of the present invention;

FIG. 3 is a top view of the deflectable seat back mechanism of the present invention;

FIG. 4 is an exploded assembly view of the detachable seat back mechanism of the present invention;

FIG. 5 is an partial exploded assembly view of a second embodiment of the deflectable seat back mechanism illustrating an adjustment mechanism adapted thereto.

DETAILED DESCRIPTION OF THE INVENTION

Figure 2:
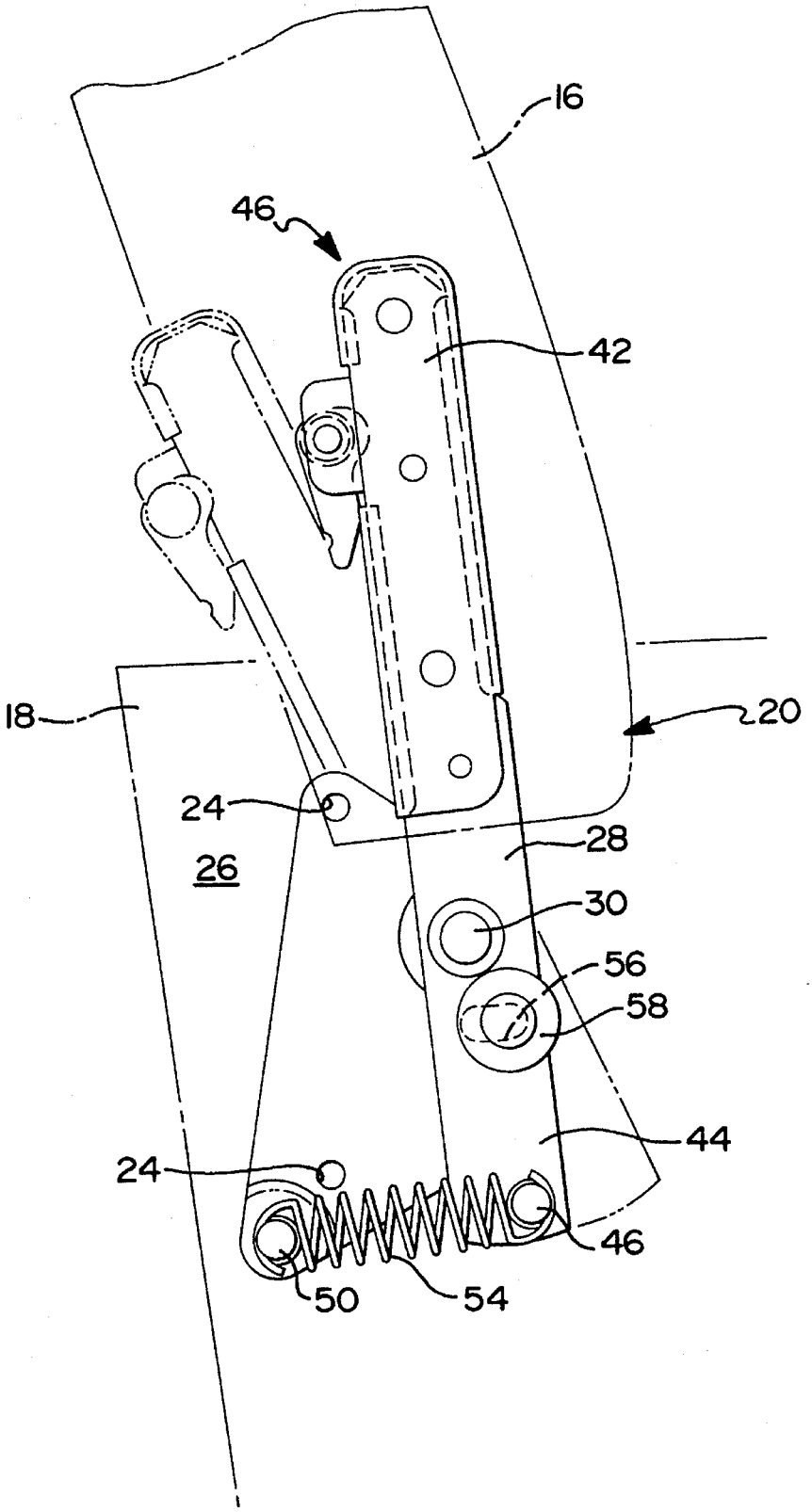
FIG. 2 is a view similar to FIG. 1 enlarged to illustrate the details of the deflectable seat back mechanism of the present invention.

With particular reference to the drawings, an exemplary chair 10 is shown to include a base 12, an upholstered seat member 14, an upholstered seat back 16 and upholstered side frames 18. Upholstered seat back 16 is adapted to be releasably secured to chair 10 in a predetermined orientation with respect to seat member 14. As will be described, a deflectable seat back mechanism 20 is incorporated into chair 10 for permitting seat back 16 to be deflected relative to seat base 14, i.e., increasing the included angle between seat back 16 and seat base 14, upon pressure applied to seat back 16 and to return to its normal orientation relative to seat base 14 upon removal of the applied pressure. While embodiments to be described hereinafter illustrate the deflectable seat back mechanism 20 incorporated into a side chair, it will be appreciated that the present invention can also be used with alternate chair configurations and other articles of furniture such as sofas, loveseats, and the like.

FIG. 2 illustrates a first preferred embodiment of the deflectable chair back mechanism 20 of the present invention in greater detail. More particularly plate member 22 is adapted to be secured to an inner portion 26 of side frames 18 such as by threaded fasteners (not shown) extending through apertures 24 formed therein. An upstanding link member 28 is pivotably secured to plate member 22 by, for example, headed pin 30 extending through aperture 32 formed in link member 28 and secured in aperture 34 formed in plate member 22, As best seen in FIG. 4, a spacer 36 is provide and plate member 22 is formed with an embossed surface 38 to maintain separation of link member from plate member 22. Also, wave washers 40 are provided to ensure that link member 28 remains snugly secured to plate member 22.

Upstanding link member 28 includes an upper portion 42 and a lower portion 44. A pin 46 is secured through an aperture 48 formed in lower portion 44, and a similar pin 50 is secured through an aperture 52 formed in plate member 22. A coil spring member 54 is secured between pins 50 and 46. Lower portion 44 is also formed with an arcuate lost-motion slot 56 which is located between headed pin 30 and pin 46. A second headed pin 58 is secured through lost-motion slot 48 and into an aperture 60 formed in plate member 22. Plate member 22 is formed with an embossed surface 62, and a spacer 64 and flat washers 66 are provided, as previously described, to maintain separation of link member 28 from plate member 22 and for maintaining a snug connection. As will be appreciated, lost-motion slot 56 limits the amount of pivoting motion of upstanding link member with respect to plate member 22.

Upper portion 42 of upstanding link member 28 is adapted to detachably receive detachable seat back bracket 46 secured to seat back 16 by, for example, threaded fasteners (not shown). A suitable formation for upper portion 42 and a detachable seat back bracket 46 are fully disclosed and described in commonly assigned U.S. Pat. No. 5,184,871, the disclosure of which is hereby expressly incorporated by reference.

A pair of deflectable seat back mechanisms are used on each side of chair 10, and a seat back 16 is detachably secured to chair 10. As will be appreciated pressure now applied to seat back 16 will cause a pivoting of upstanding link members 28 relative to plate members 22, and hence, a deflection of seat back 16 relative to seat base 14. The pivoting motion, however, is resisted by spring members 54 such that a minimum amount of pressure must be applied to seat back 16 to achieve the desired deflection. When the pressure is released from seat back 16, spring members 54 act to return seat back 16 to its original orientation with respect to seat base 14. Lost-motion slots 56 and pins 58 limit the amount of deflection of seat back 16 and ensure that seat back 16 is returned to its original orientation upon removal of the applied pressure. Moreover, the two point interconnection, i.e., at pins 30 and 58, and the rigid construction of deflectable seat back mechanism inhibits torsional or lateral deflection of seat back 16, and hence, provides an enhanced deflectable seat back structure.

FIG. 5 illustrates a second preferred embodiment of the present invention in which pin 58 is replaced with an adjustable friction assembly 70. In the second embodiment, the amount of pressure required to deflect seat back 16 may be selectively adjusted by use of adjustable friction assembly 70, in conjunction with spring member 54 on each deflectable seat back mechanism 20. Adjustable friction assembly 70 includes a screw 72 which extends through aperture 60' and lost-motion slot 56 and is secured by spring 74, washer 76 and wing nut 78. Aperture 60' has a square configurations for engaging flats 73 formed on a shoulder portion of screw 72. A spacer 64 is used as described, and washers 80 are disposed on either side of upstanding link 28. By selectively tightening or loosening wing nut 78, the clamping pressure exerted by spring 74 and washers 76 on upstanding link 28 is correspondingly increased or decreased, and hence, the friction therebetween is increased or decreased. Therefore, by selectively increasing or decreasing the frictional resistance on upstanding link 28 in this manner, the amount of pressure on seat back 16 to cause deflection can be adjusted. It should also be appreciated, however, that simply changing the rate spring member 54 also provides a means for adjusting the amount of pressure required to cause deflection of seat back 16.

Figure 6:
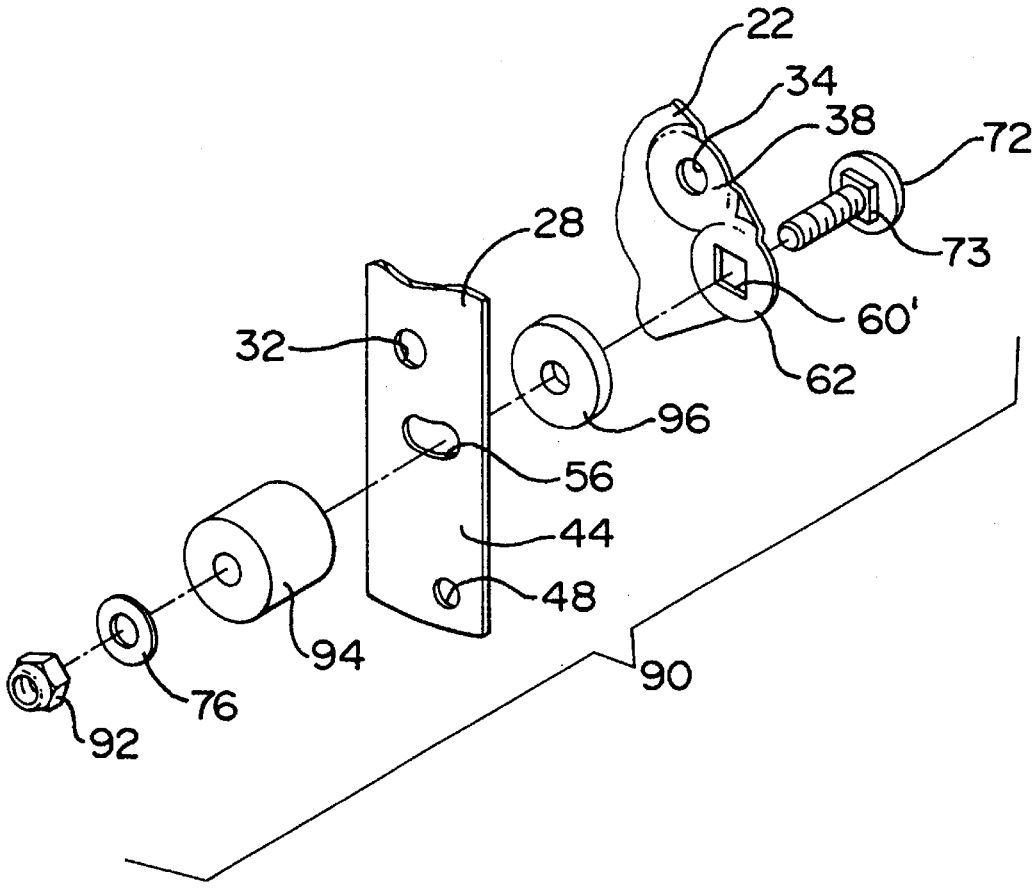
FIG. 6 is an partial exploded assembly view of a third embodiment of the deflectable seat back mechanism illustrating an alternative adjustment mechanism adapted thereto.

FIG. 6 illustrates another preferred embodiment of the present invention in which the adjustable friction assembly 70 has been modified. Like reference numerals are used to identify like elements to those of the embodiment shown in FIG. 5.

With reference then to FIG. 6, adjustable friction assembly 90 includes a fine threaded screw 72' extending through aperture 60' and lost-motion slot 56 and is secured by washer 76 and lock nut 92. A fine threaded screw 72 is preferred over standard or coarse threaded screws to provide enhanced adjustment capability. A washer shaped nylon block 94 is disposed about screw 72 and is secured between washer 76 and upstanding link 28 with nylon block 94 bearing against upstanding link 28. A second nylon block 96 is disposed about screw 72 on the opposing side of upstanding link 28 adjacent plate member 22. As will be appreciated selectively tightening or loosening nut 92, increases or decreases the force at which nylon blocks 94 and 96 bear against upstanding link 28 increasing or decreasing the frictional force therebetween. Therefore, by selectively increasing or decreasing the frictional resistance on upstanding link 28 in this manner, the amount of pressure on seat back 16 to cause deflection can be adjusted.

The adjustable friction assembly 90 allows for use of deflectable seat back mechanism 20 on chairs having higher seat backs which result in higher moments in response to pressure applied to the seat back. It should be noted that in both adjustable friction assembly 70 and adjustable friction assembly 90 it is the friction of washers 66 and nylon blocks 94 and 96, respectively against upstanding link member 28 which provided resistance to the pivoting motion of seat back 16. In each of these embodiments, spring member 54 sets primarily to return seat back 16 to an upright position. Moreover, it should be understood that the geometry of deflectable seat back mechanism, i.e., the relationships between aperture 32, slot 56 and aperture 48, can be varied to alter the resistance to reclining motion.

Adjustable friction assembly 90 also provides the additional feature of allowing the seat back to be deflected and maintained at some desired angle. This is accomplished by tightening lock nut 92 such that the frictional force between nylon blocks 94 and 96 is greater than the return force exerted by spring member 54. In this manner, the seat occupant applies pressure to seat back 16 which deflects, as described, to some angle. The friction force exerted by nylon blocks 94 and 96 on upstanding link member 28 acts to maintain seat back 16 in the deflected position over the return force of spring member 54. The seat occupant can then manually return seat back 16 to the upright position by applying pressure in the opposite direction. In the preferred embodiment, deflectable seat back mechanism 20 provides between about 5 and 10 degrees of deflection.

The foregoing discussion discloses end describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A deflectable seat back mechanism for supporting a seat back relative to a seat base in a seating unit having a base and a frame, the deflectable seat back mechanism comprising:

a plate member secured to the frame;

a link member pivotably secured to the plate member;

a spring member interconnecting the plate member and the link member;

a lost-motion slot formed in the link member and a pin member extending through The lost-motion slot and being secured to the plate member for limiting pivoting motion of link member with respect to the plate member; and means for connecting the seat back to the link member.

2. The deflectable seat back mechanism of claim 1 further comprising adjustable friction means for selectively resisting pivoting motion of the link member with respect to the plate member.

3. The deflectable seat back mechanism of claim 2 wherein the pin member has threads and the adjustable friction means comprises a compression spring disposed about the pin member, first and second washers disposed adjacent the link member and a threaded fastener secured to the pin such that tightening of the threaded fastener onto the pin member causes compression of the spring and clamping of the washers to the link member for creating frictional force therebetween.

4. The deflectable seat back mechanism of claim 2 wherein the pin member has threads and the adjustable friction means comprises a washer shaped nylon block disposed about the pin member and secured thereto by a threaded fastener such that tightening of the threaded fastener onto the pin member causes clamping of the nylon block to the link member for creating frictional force therebetween.

5. The deflectable seat back mechanism of claim 1 wherein the means for connecting the seat back to the link member is further operable to detachably connect the seat back to the link member.

6. The deflectable seat back mechanism of claim 1 wherein said spring member is connected to said link member below the pivotable connection of said link member to said plate member.

7. In a chair having a base, side frames and a seat base a deflectable seat back mechanism for interconnecting a seat back relative to the seat base for limited pivoting motion, the deflectable seat back mechanism comprising:

a plate member secured to a side frame;

an upstanding link member pivotably secured to the plate member and having an upper portion and a lower portion, the upper portion being adapted to detachably receive a seat back;

a spring member interconnecting the lower portion of the upstanding link to the plate member for resisting pivoting motion therebetween;

a lost-motion slot formed in the lower portion;

a pin extending through the lost-motion slot and secured to the plate member such that engagement of the pin with the slot limits pivoting motion of the upstanding link relative to the plate member; and adjustable friction means for selectively resisting pivoting motion of the upstanding link member with respect to the plate member.

8. The deflectable seat back mechanism of claim 7 herein the pin has threads and the adjustable friction means comprises a compression spring disposed about the pin, first and second washers disposed adjacent the link member and a wing nut secured to the pin such that tightening of the wing nut onto the pin causes compression of the spring and clamping of the washers to the link member for creating frictional force therebetween.

9. The deflectable seat back mechanism of claim 7 wherein the pin member has threads and the adjustable friction means comprises a washer shaped nylon block disposed about the pin member and secured thereto by a threaded fastener such that tightening of the threaded fastener onto the pin member causes clamping of the nylon block to the link member for creating frictional force therebetween.

* * * * *